US009129527B2

(12) United States Patent
Kim

(10) Patent No.: US 9,129,527 B2
(45) Date of Patent: Sep. 8, 2015

(54) SOUND PLAYING SYSTEM OF A CLUSTER

(71) Applicant: Hyundai Motor Company, Seoul (KR)

(72) Inventor: Seong Un Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 348 days.

(21) Appl. No.: 13/714,082

(22) Filed: Dec. 13, 2012

(65) Prior Publication Data

US 2014/0119565 A1 May 1, 2014

(30) Foreign Application Priority Data

Oct. 30, 2012 (KR) ..... 10-2012-0121387

(51) Int. Cl.
*G08G 1/0962* (2006.01)
*G10K 15/02* (2006.01)
*G08G 1/16* (2006.01)

(52) U.S. Cl.
CPC ..... *G08G 1/0962* (2013.01); *G10K 15/02* (2013.01); *G08G 1/16* (2013.01)

(58) Field of Classification Search
None
See application file for complete search history.

(56) References Cited

U.S. PATENT DOCUMENTS 4,346,364 A * 8/1982 Takagi et al. ..... 340/460
4,352,089 A * 9/1982 Yano et al. ..... 340/460
4,359,713 A * 11/1982 Tsunoda ..... 381/107
4,373,116 A * 2/1983 Shimizu et al. ..... 340/461
4,559,569 A * 12/1985 Otsuki et al. ..... 360/65
5,204,971 A * 4/1993 Takahashi et al. ..... 381/86
8,139,446 B2 * 3/2012 Ieda et al. ..... 369/7
2011/0170701 A1 7/2011 Sakamoto et al.

FOREIGN PATENT DOCUMENTS

JP 60065630 A * 4/1985
JP 2010226413 A 10/2010
KR 10-2001-0063985 7/2001
KR 2006-0098468 A 9/2006

* cited by examiner

*Primary Examiner* — Thang Tran

(74) *Attorney, Agent, or Firm* — Mintz Levin Cohn Ferris Glovsky and Popeo, P.C.; Peter F. Corless

(57) ABSTRACT

Disclosed is a sound playing system of a cluster which improves a driver's recognition of and quality of sounds played by the cluster. The sound playing system transmits driving information of a vehicle to a driver through the sound played by the cluster, and may include: a micom mounted in the cluster for supervising various controls such as sound control; a sound source chip mounted in the cluster for selecting sound sources according to a command of the micom; and a speaker for generating sound waves by the selected sound sources and outputting a sound. A database of sounds may be stored in the micom, and the micom may transmit information regarding sounds to the sound source chip based on the database so as to control selection of the sound sources.

16 Claims, 1 Drawing Sheet

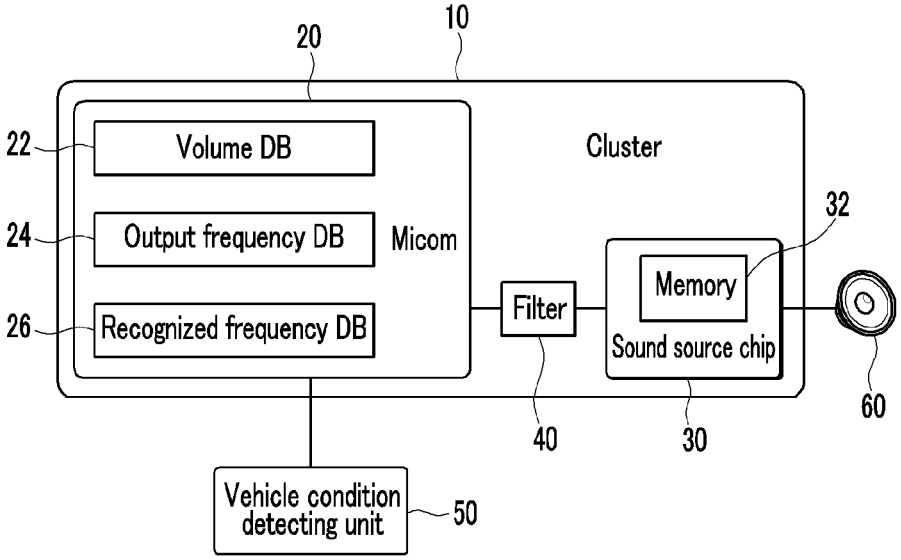
10
20
22
Volume DB
Cluster
24
Output frequency DB
Micom
32
Memory
26
Recognized frequency DB
Filter
Sound source chip
60
40
30
Vehicle condition detecting unit
50

SOUND PLAYING SYSTEM OF A CLUSTER

CROSS-REFERENCE TO RELATED APPLICATION

This application claims priority to and the benefit of Korean Patent Application No. 10-2012-0121387 filed in the Korean Intellectual Property Office on Oct. 30, 2012 , the entire contents of which are incorporated herein by reference.

BACKGROUND OF THE INVENTION (a) Field of the Invention

The present invention relates to a sound playing system of a cluster. More particularly, the present invention relates to a sound playing system of a cluster which improves driver safety.

(b) Description of the Related Art

A cluster (also referred to as an instrument cluster) is generally a component that is mounted in an instrument panel and is adapted to surround a combination meter. The combination meter is a device in which a variety of warning lamps and meters, such as a speed meter, an engine tachometer, and a fuel gauge, are mounted.

Recently, developments in electronics engineering has prompted changes in the disposition and design of vehicle the meters. In particular, the disposition and design of the meters have been developed so as to more precisely transmit necessary information and warnings to a driver.

The cluster is generally provided such that driving conditions and status information of a vehicle can be easily recognized by the driver. In addition, the cluster can be provided so as to transmit the driving conditions and status information of the vehicle to the driver through realistic images, graphics, warnings, voice, and so on.

However, it may sometimes be difficult for the driver to understand or recognize the warning sounds and voice information that transmits the driving conditions and status information. In particular, the warning sounds and the voice information may not be easily recognized in certain driving conditions, such as, for example, during high speed driving or while the air conditioner is operating.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a sound playing system of a cluster, particularly a sound playing system that improves driver recognition of the sound played by the cluster.

The present invention further provides a sound playing system of a cluster that provides an upgrade in the quality of a sound played by the cluster.

According to one aspect, the sound playing system of a cluster transmits driving information of a vehicle to a driver through sounds played by (outputted from) the cluster. According to an embodiment, the system includes: a micom mounted in the cluster and configured for supervising various controls including a sound control; a sound source chip mounted in the cluster and configured for selecting sound sources based on a command from the micom; and one or more speakers for generating sound waves by the sound sources selected in the sound source chip and for outputting a sound. In addition, a database may be provided and configured for storing one or more sounds in the micom. According to various embodiments, the micom may transmit information regarding sounds to the sound source chip based on the database, to thereby control which sound sources are selected.

According to various embodiments, the system may further include a filter configured for receiving frequency data from the micom, amplifying and changing frequency of the received frequency data, and transmitting the amplified/changed frequency data to the sound source chip.

According to various embodiments, the database is configured for storing internal noises of the vehicle.

According to various embodiments, the database is configured for storing warning sounds for informing a driver of a dangerous situation.

According to various embodiments, the database is configured for storing voice information for informing a driver of driving information and conditions of the vehicle.

According to various embodiments, the database includes: a volume database ("DB") comprising data sets regarding internal noises of the vehicle generated in various conditions according to driving of the vehicle; an output frequency DB comprising data sets regarding frequency characteristics for each internal noise of the vehicle; and a recognized frequency DB comprising data sets of which frequency characteristics of the sounds played by the cluster are detected at a position of a driver.

According to various embodiments, the micom controls a volume of sound played by the cluster according to internal noises of the vehicle based on the volume DB.

According to various embodiments, a predetermined range of frequencies are stored in the micom, and the micom monitors the internal noises of the vehicle. Further, a frequencies of the sounds played by the cluster are amplified when the internal noises of the vehicle corresponding to the predetermined frequency range are generated based on the output frequency DB.

According to various embodiments, the system further includes a filter configured for increasing frequency gain of the frequency data received from the micom. For example, the frequencies of the sounds played by the cluster may be amplified by the filter.

According to various embodiments, the micom performs compensation control with respect to the frequencies of the sounds played by the cluster based on the recognized frequency DB. As such, the frequency of a sound recognized by a driver can be made equal to a frequency of a desired sound through the cluster.

According to various embodiments, the system further includes a filter configured for changing the frequency gain of the frequency data received from the micom. For example, the frequencies of the sounds played by the cluster may be changed by the filter.

BRIEF DESCRIPTION OF THE DRAWINGS

The above and other features of the present invention will now be described in detail with reference to certain exemplary embodiments thereof illustrated in the accompanying drawings which are given hereinbelow by way of illustration only, and thus are not limitative of the present invention, and wherein:

FIG. 1 is a block diagram of a sound playing system of a cluster according to an exemplary embodiment of the present invention.

DESCRIPTION OF SYMBOLS

10: cluster

20: micom

22: volume DB
24: output frequency DB
26: recognized frequency DB
30: sound source chip
32: memory
40: filter
50: vehicle condition detecting unit
60: speaker It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

An exemplary embodiment of the present invention will hereinafter be described in detail with reference to the accompanying drawings.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, the term "user" refers to a driver of a vehicle.

Although exemplary embodiment is described as using a plurality of units to perform the exemplary process, it is understood that the exemplary processes may also be performed by one or plurality of modules. Additionally, it is understood that the term controller refers to a hardware device that includes a memory and a processor. The memory is configured to store the modules and the processor is specifically configured to execute said modules to perform one or more processes which are described further below.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

FIG. 1 is a block diagram of a sound playing system of a cluster according to an exemplary embodiment of the present invention.

As shown in FIG. 1, a sound playing system of a cluster 10 according to an exemplary embodiment of the present invention includes a micom 20, a vehicle condition detecting unit 50, a sound source chip 30, a speaker 60, and a filter 40. The micom 20, the sound source chip 30, and the filter 40 are mounted in a cluster 10.

The cluster 10 is a component that is adapted to surround a combination meter on an instrument panel (not shown). Because a cluster 10 is a component that is well-known to a person of ordinary skill in the art, a detailed description thereof will be omitted.

The micom 20 is a one-chip microprocessor having functions of a CPU, a RAM, a ROM, a timer, and so on in one integrated circuit. Such a one-chip microprocessor is typically called a micom. The micom 20 is generally used for improving the quality of products and decreasing costs. Further, the micom 20 is configured such that it can simultaneously perform various controls, such as temperature control, time control, output waveform control, and so on. In particular, the cluster 10 has a simple composition and provides improved performance when mounted in the cluster 10. In this specification, sound control through the micom 20 mounted in the cluster 10 will be described, in particular. However, the micom 20 can be configured to control various other features, such as, for example, temperature control, time control, output waveform control.

According to an embodiment of the present invention, the micom 20 is adapted to store various databases (DB), and each of the various databases may be constructed for individual purposes. For example, referring to FIG. 1, the databases of the micom 20 may include a volume DB 22, an output frequency DB 24, and a recognized frequency DB 26.

The volume DB 22 may be configured to contain data sets regarding internal noise of a vehicle generated in various conditions based on driving conditions of the vehicle. Thus, for example, at least one data set may be selected in the volume DB 22 based on a current driving condition of the vehicle.

The micom 20 can be configured to receive the selected internal noise data from the volume DB 22. In addition, the micom 20 can be configured to control the volume of sound (radiophonics) played by the cluster 10 based on the received internal noise data. In particular, the micom 20 is configured to perform compensation control of a volume of the radiophonics.

According to an embodiment of the present invention, the output frequency DB 24 may be configured to contain data (frequency data) sets regarding frequency characteristic at each internal noise level of the vehicle. Thus, for example, at least one frequency data set may be selected in the output frequency DB 24 based on a current internal noise level of the vehicle.

Meanwhile, according to an equal loudness contour (which is understood to refer to a measure of sound pressure, over the frequency spectrum, for which a listener perceives a constant loudness when presented with pure steady tones, a sound pressure level recognized by human ears is determined by each frequency of sounds. Therefore, human ears may have low recognition of sounds of a particular frequency.

The micom 20 can be configured to receive the selected frequency data from the output frequency DB 24. In addition, the micom 20 can be configured to determine whether the received frequency data corresponds to a predetermined frequency range. As referred to herein, the predetermined frequency range embraces a band of the particular frequency of which the recognition is low. If the frequency data transmitted to the micom 20 corresponds to the predetermined frequency range, the micom 20 controls the frequency of the sound so as to increase "gain" thereof. As referred to herein, the gain is a ratio at which an output signal is changed with reference to an input signal size, and the gain is measured in decibels (dB). Thus, the micom 20 is configured to control amplification of the frequency of the radiophonics outputted from the cluster 10 so as to improve recognition thereof.

The recognized frequency DB 26 may comprise data sets for detecting the frequency characteristic of the radiophonics at a position of a driver.

According to embodiments of the present invention, the frequency of the radiophonics may be distorted while the radiophonics outputted from the cluster and is transmitted to the ears of a driver. For example, the distortion of the frequency may be generated by the interior disposition of the vehicle. Thus, the recognized frequency DB 26 can be configured to store data (distortion frequency data) sets regarding the frequency characteristic that is distorted while transmitting the radiophonics to the ears of a driver.

In the recognized frequency DB 26, distortion frequency data corresponding to the frequency data selected in the output frequency DB 24 is selected.

The micom 20 is configured to receive the selected distortion frequency data from the recognized frequency DB 26. The micom 20 is further configured to output the radiophonics of the cluster 10 based on the received distortion frequency data in such a way that the internal noise of the vehicle is transmitted to the ears of a driver without distortion of the frequency. In other words, the micom 20 can be configured to perform compensation control such that a sound that is equal to the internal noises of the vehicle is recognized by a driver.

According to embodiments of the present invention, the vehicle condition detecting unit 50 is configures to includes a device for detecting speed of the vehicle and one or more sensors for detecting operations of electronic devices mounted in the vehicle. Some examples of device that may be used for detecting speed of the vehicle include a vehicle speed detecting sensor which using pulses, a transmission control unit (TCU), an anti-lock brake system (ABS), and so on. As referred to herein, the TCU is a device that receives information from sensors mounted at an engine and an automatic transmission, and controls operations of a damper clutch and the automatic transmission. As referred to herein, the ABS is a safety system that prevents lockup of tires during braking of the vehicle. These devices and sensors for detecting speed and conditions of the vehicle are well-known to a person of ordinary skill in the art, and, thus, further detailed descriptions thereof will be omitted.

According to embodiments of the present invention, the vehicle condition detecting unit 50 is configured to transmit information about the speed of the vehicle and operations of the electronic devices to the micom 20. In addition, the micom 20 may be configured to control the volume of the radiophonics of the cluster 10 according to information transmitted from the vehicle condition detecting unit 50. Thus, for example, the micom 20 may determine internal noises of the vehicle based on the noise data transmitted from the volume DB 22 and the information transmitted from the vehicle condition detecting unit 50, and may perform compensation control with respect to the volume of the radiophonics of the cluster 10. According to embodiments of the present invention, the information may be transmitted between the vehicle condition detecting unit 50 and the micom 20 by a controller area network (CAN) bus.

According to embodiments of the present invention, the sound source chip 30 is adapted to store a substantial amount of sound sources which can form the various radiophonics according to internal noises of the vehicle. These sound sources may be stored to a memory 32 mounted in the sound source chip 30. The sound source chip 30 may be adapted to select the sound source so as to form the radiophonics based on a command of the micom 20. Thus, for example, the sound source chip 30 may be adapted to select the sound source which will form the radiophonics corresponding to internal noises of the vehicle from among the various sound sources stored in the memory 32.

According to embodiments of the present invention, the speaker 60 is a device which is adapted to convert electrical oscillation to acoustic oscillation and broadcast the generated sound waves to space. In addition, the speaker 60 may generate the sound waves based on the electrical signals of the sound sources selected in the sound source chip 30, and may then output the radiophonics.

As shown in FIG. 1, the filter 40 can be interposed between the micom 20 and the sound source chip 30. The filter 40 is configured to amplify the frequency of the frequency data transmitted from the micom 20. Thus, for example, if the micom 20 determines that the frequency data transmitted from the output frequency DB 24 corresponds to the predetermined frequency range, then the filter 40 can increase the gain of the frequency data corresponding to the predetermined frequency range as commanded by the micom 20. In addition, if the micom 20 determines that compensation control is required based on the distortion frequency data transmitted from the recognized frequency DB 26, then the filter 40 can change the gain of the frequency data as commanded by the micom 20 such that a sound that is equal to the internal noises of the vehicle is recognized by a driver.

Accordingly, recognition of the internal noises of the vehicle transmitted through the radiophonics of the cluster 10 is improved through amplification and compensation control of the frequency based on particular frequency data. This control of the radiophonics may be applied to voice information in accordance with the present invention.

According to embodiments of the present invention, the cluster 10 outputs the radiophonics corresponding to the internal noises of the vehicle, and further delivers warning sounds and voice information based on the driving conditions and status of the vehicle. In particular, the radiophonics of the cluster 10 can include a sound notifying the internal noises of the vehicle, and a sound delivering a warning sound and voice information. As referred to herein, a warning sound is a sound that notifies a driver of a dangerous situation, and voice information is a sound that informs a driver of driving information and conditions of the vehicle. In addition, according to an exemplary embodiment of the present invention, the sound playing system of a cluster can further perform the above-described volume and frequency control such that the recognition by a driver of the warning sound and the voice information of the cluster 10 is improved.

According to an exemplary embodiment of the present invention, the internal noises of the vehicle, the warning sound, and the voice information are played while taking into account the driving conditions and status of the vehicle based on the databases 22, 24, and 26 that are pre-stored in the micom 20. As such, the radiophonics of the cluster 10 can be better recognized by a driver. Further, the frequency compensation with respect to the radiophonics of the cluster 10 is performed according to the frequency characteristics of the vehicle such that quality of the radiophonics played by the cluster 10 is improved.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A sound playing system for a cluster that transmits driving information of a vehicle to a driver through sounds played by the cluster, the system comprising:

a micom disposed in the cluster and configured and arranged for monitoring various controls, including sound control;

a sound source chip disposed in the cluster and configured and arranged for selecting sound sources based on a command received from the micom;

a speaker configured and arranged for generating sound waves by the sound sources selected in the sound source chip and for outputting a sound; and a filter configured and arranged for receiving frequency data from the micom, amplifying and changing frequency of the received frequency data, and transmitting the frequency data which has been amplified and changed to the sound source chip, wherein the micom is provided with a database of sounds, and the micom is configured and arranged for transmitting information regarding sounds to the sound source chip based on the database so as to control selection of sound sources.

2. The sound playing system of claim 1, wherein the database is a database of internal noises of the vehicle.

3. The sound playing system of claim 1, wherein the database is a database of warning sounds for informing a driver of a dangerous situation.

4. The sound playing system of claim 1, wherein the database is a database of voice information for informing a driver of driving information and conditions of the vehicle.

5. The sound playing system of claim 1, wherein the database comprises:

a volume DB which includes data sets of internal noises of the vehicle generated in various conditions based on driving conditions of the vehicle;

an output frequency DB which includes data sets of frequency characteristics for each internal noise of the vehicle; and a recognized frequency DB which includes data sets of frequency characteristics of the sound played by the cluster detected at a position of the driver.

6. The sound playing system of claim 5, wherein the micom is configured and arranged to control a volume of sound played by the cluster according to internal noises of the vehicle based on the volume DB.

7. The sound playing system of claim 5, wherein a predetermined range of frequency is stored in the micom, and the micom is configured and arranged for monitoring the internal noises such that a frequency of the sound played by the cluster is amplified when the internal noises of the vehicle corresponding to the predetermined frequency range, and a frequency is generated based on the output frequency DB.

8. The sound playing system of claim 7, further comprising a filter configured and arranged for increasing frequency gain of the frequency data received from the micom, wherein the frequency of the sound played by the cluster is amplified by the filter.

9. The sound playing system of claim 5, wherein the micom configured and arranged for performing compensation control regarding the frequency of the sound played by the cluster based on the recognized frequency DB such that frequency of a sound recognized by a driver is controlled to equal a frequency of a desired sound through the cluster.

10. The sound playing system of claim 9, further comprising a filter configured and arranged for changing the frequency gain of the frequency data received from the micom, wherein the frequency of the sound played by the cluster is changed by the filter.

11. A sound playing system for a cluster that transmits driving information of a vehicle to a driver through sounds played by the cluster, the system comprising:

a micom disposed in the cluster and configured and arranged for monitoring various controls, including sound control;

a sound source chip disposed in the cluster and configured and arranged for selecting sound sources based on a command received from the micom; and a speaker configured and arranged for generating sound waves by the sound sources selected in the sound source chip and for outputting a sound, wherein the micom is provided with a database of sounds, and the micom is configured and arranged for transmitting information regarding sounds to the sound source chip based on the database so as to control selection of sound sources; and wherein the database comprises:

a volume DB which includes data sets of internal noises of the vehicle generated in various conditions based on driving conditions of the vehicle;

an output frequency DB which includes data sets of frequency characteristics for each internal noise of the vehicle; and a recognized frequency DB which includes data sets of frequency characteristics of the sound played by the cluster detected at a position of the driver.

12. The sound playing system of claim 11, wherein the micom is configured and arranged to control a volume of sound played by the cluster according to internal noises of the vehicle based on the volume DB.

13. The sound playing system of claim 11, wherein a predetermined range of frequency is stored in the micom, and the micom is configured and arranged for monitoring the internal noises such that a frequency of the sound played by the cluster is amplified when the internal noises of the vehicle corresponding to the predetermined frequency range, and a frequency is generated based on the output frequency DB.

14. The sound playing system of claim 13, further comprising a filter configured and arranged for increasing frequency gain of the frequency data received from the micom, wherein the frequency of the sound played by the cluster is amplified by the filter.

15. The sound playing system of claim 11, wherein the micom configured and arranged for performing compensation control regarding the frequency of the sound played by the cluster based on the recognized frequency DB such that frequency of a sound recognized by a driver is controlled to equal a frequency of a desired sound through the cluster.

16. The sound playing system of claim 15, further comprising a filter configured and arranged for changing the frequency gain of the frequency data received from the micom, wherein the frequency of the sound played by the cluster is changed by the filter.

* * * * *